US005711017A

United States Patent [19]

Bitler et al.

[11] Patent Number: 5,711,017

[45] Date of Patent: Jan. 20, 1998

[54] PROCESS FOR THE DESTRUCTION OF CHEMICAL AGENTS AND MUNITIONS

[75] Inventors: John A. Bitler, Denver; John P. Baranski, Sinking Spring, both of Pa.; Harold R. Larson, Spring, Tex.

[73] Assignee: Exide Corporation, Reading, Pa.

[21] Appl. No.: 715,486

[22] Filed: Sep. 18, 1996

Related U.S. Application Data

[60] Provisional application No. 60/003956 Sep. 19, 1995.

[51] Int. Cl.[6] ..... A62D 3/00

[52] U.S. Cl. ..... 588/200; 588/202; 588/227; 110/346

[58] Field of Search ..... 588/200, 202, 588/227; 110/237, 346; 422/186.22; 75/10.19

[56] References Cited

U.S. PATENT DOCUMENTS

| | | | |
|---|---|---|---|
| 1,492,241 | 4/1924 | Carpenter et al. . | |
| 1,515,616 | 11/1924 | Poppenhusen . | |
| 1,715,262 | 5/1929 | White . | |
| 2,049,633 | 8/1936 | Thomsen . | |
| 2,756,044 | 7/1956 | Neumann . | |
| 2,826,490 | 3/1958 | Neumann . | |
| 3,561,684 | 2/1971 | Fischer . | |
| 3,940,551 | 2/1976 | Ling et al. . | |
| 3,999,000 | 12/1976 | Stenkvist . | |
| 4,102,676 | 7/1978 | Jaquay . | |
| 4,115,109 | 9/1978 | Libach et al. . | |
| 4,177,061 | 12/1979 | Stenkvist et al. | 75/10.61 |
| 4,180,251 | 12/1979 | Jaquay | 266/172 |
| 4,229,271 | 10/1980 | Prengaman et al. . | |
| 4,310,351 | 1/1982 | Lieberman . | |
| 4,340,421 | 7/1982 | Bergsoe . | |
| 4,431,612 | 2/1984 | Bell et al. | 422/186.21 |
| 4,571,261 | 2/1986 | Buren et al. . | |
| 4,644,877 | 2/1987 | Barton et al. | 110/250 |
| 4,877,640 | 10/1989 | Muehlberger et al. . | |
| 5,122,181 | 6/1992 | Dube et al. | 75/10.21 |
| 5,138,959 | 8/1992 | Kulkarni | 110/346 |
| 5,203,908 | 4/1993 | Lindsay et al. | 75/10.35 |
| 5,284,503 | 2/1994 | Bitler et al. | 75/10.19 |
| 5,439,498 | 8/1995 | Bitler et al. | 75/10.19 |
| 5,584,071 | 12/1996 | Kalyon et al. | 588/200 |

FOREIGN PATENT DOCUMENTS 0 216 618 1/1987 European Pat. Off. .

OTHER PUBLICATIONS

"Energy–Saving DC Twin Shell Arc Furnace For Melting Low–Grade Scrap", ABB Review (Sep./Oct. 1996).

Chalfant, "Recovering Zinc and Iron From Electric–Furnace Dust", *New Steel*, p. 91, Sep. 1996.

Mintek, Application Report No. 11, "The Development, Up to Industrial Scale, of a Transferred Plasma–Arc Smelting Process for the Production of Ferro–Alloys" (1991).

Pyromet/Mintek, "Hollow Graphite Electrode D.C. Arc Furnace and Recovery Plant for Treatment of Steel Plant Dust" (1991).

Mintek, Technology International, "Safe Disposal of Environmentally Unacceptable Dust" (1991).

Wang et al, "Recovering Zn, Pb, Cd and Fe from Electric Furnace Dust", Journal of Metallurgy, pp. 42–45, Apr. 1990.

Bunney et al, "The Commercial Development of Plasma Technology: EAF Dust Application", AIME Conference, San Diego, Mar. 1992.

Erriksson, "The Plasmazinc Process for Recovery of Zince from Primary and Secondary Materials", Zinc '85, Ch. 52, pp. 827–839 (1985).

Bygden et al, "Application of Kellogg's Model to the Slag–Fuming Practice in Sweden", Zinc '85, Ch. 11, pp. 171–183 (1985).

(List continued on next page.)

*Primary Examiner*—Ngoclan Mai

*Attorney, Agent, or Firm*—Nixon & Vanderhye P.C.

[57] ABSTRACT

Chemical agents, such as chemical munitions, are decomposed by bringing them into contact with a plasma arc of a DC plasma arc furnace operated at a temperature of greater than about 30,000° F.

11 Claims, 1 Drawing Sheet

OTHER PUBLICATIONS

Penberthy, "Why Glass is a good Host for Hazardous Waste", Glass Industry, pp. 22–24, May 1992.

Roy, "Cyclone Furnace Destroys Organics, Immobilizes Heavy Metals, Radionuclides", Hazmat World, pp. 59–60 (Aug. 1992).

"Waste Minimization—Selected Topics", The Hazardous Waste Consultant, pp. 1.22–1.24 (Sep./Oct. 1991).

Plasma Gasification Could Set New Standards For Municipal Solid Waste Disposal, Enersearch, Ontario Ministry of Energy (1986).

"Appliation of Plasma Technology in the Environmental Waste Processing Industry", CMP Report No. 92–5 (Jul. 1992).

Plasma Arcs Sputter New Waste Treatment, Chemical Engineering, pp. 32–35 (Dec. 1991).

Royer et al, "Control TEchnologies for REmediation of Contaminated Soil and Waste Deposits at Superfund Lead Battery Recycling Sites", J. Air Waste Manage. Assoc., pp. 970–980, 1992.

PROCESS FOR THE DESTRUCTION OF CHEMICAL AGENTS AND MUNITIONS

CROSS-REFERENCE TO RELATED APPLICATIONS

This application is related to, and claims domestic priority benefits under 35 USC §119(e) from, U.S. Provisional application Ser. No. 60/003,956 filed on Sep. 19, 1995, the entire content of which is expressly incorporated hereinto by reference.

FIELD OF INVENTION

The present invention relates generally to the destruction of chemical agents, particularly chemical agents employed as military weapons (conventionally termed "chemical munitions"). In a preferred embodiment, the present invention involves bringing chemical munitions into contact with a DC arc of a DC arc furnace such that the chemical munitions' large molecule decomposes into ionized fragments which are relatively harmless.

BACKGROUND AND SUMMARY OF THE INVENTION

Governments are under increasing political pressures to destroy chemical agents which have been stockpiled as munitions. However, the destruction of such chemical munition stockpiles is not a simple task since they are, of course, extremely hazardous and toxic materials. Thus, in order to destroy chemical munitions, a technology must be developed which affords a high degree of worker and environmental protection against the harmful effects of the chemical agents employed as munitions. It is toward providing such a technology that the present invention is directed.

Broadly, the present invention involves the destruction of chemical munitions by bringing them into contact with a plasma arc of a DC plasma arc furnace. In particularly preferred forms, the munitions are subjected sequentially to two high temperature zones within the furnace. The first high temperature zone is established immediately below the electrode in the plasma arc, while the second high temperature zone is in the form of a "slag" which circulates by induction and natural arc stirring relative to the first zone. The chemical munitions with some metallic casings are fed into the furnace through a hollow electrode member cocurrently with the plasma gas. As such, the chemical munitions first encounter the ultrahigh temperature (e.g., greater than 30,000° F.) immediately below the electrode in the first high temperature (plasma) zone. The chemical munitions encountering such high temperature will decompose into constituent fragments and be ionized. The relatively large molecules of the chemical munitions will therefor be dissociated into ionized monatomic and diatomic fragments such as hydrogen, oxygen, nitrogen, carbon monoxide, carbon dioxide, hydrogen chloride, hydrogen fluoride and phosphorus pentoxide. Particulates larger than ⅝" nominal diameter are fed through a roof port after the proper slag depth is established.

The second high temperature zone is the gas phase above the molten slag. It will be at a temperature almost as hot as the slag—that is, at least about 3,000° F. Chemical decomposition reactions are completed in the hot gas of the second high temperature zone. Furthermore, controlled additions of an oxidizing gas, such as oxygen, air, or steam, may be introduced into the gas space within the furnace either through the hollow electrode, or through an auxiliary port in the roof of the furnace. The preferred embodiment utilizes a metered quantity of oxygen for this purpose so as to minimize the volume of off-gas produced.

The slag is essentially amorphous, and when cooled is non-leachable.

These and other aspects and advantages of this invention will become more clear after careful consideration is given to the following detailed description of the preferred exemplary embodiments.

BRIEF DESCRIPTION OF THE DRAWINGS

Reference will hereinafter be made to accompanying FIG. 1 which schematically depicts a cross-sectional view of a DC plasma arc furnace that may be employed in the practice of this invention.

DETAILED DESCRIPTION OF THE PREFERRED EXEMPLARY EMBODIMENTS

Figure 1:
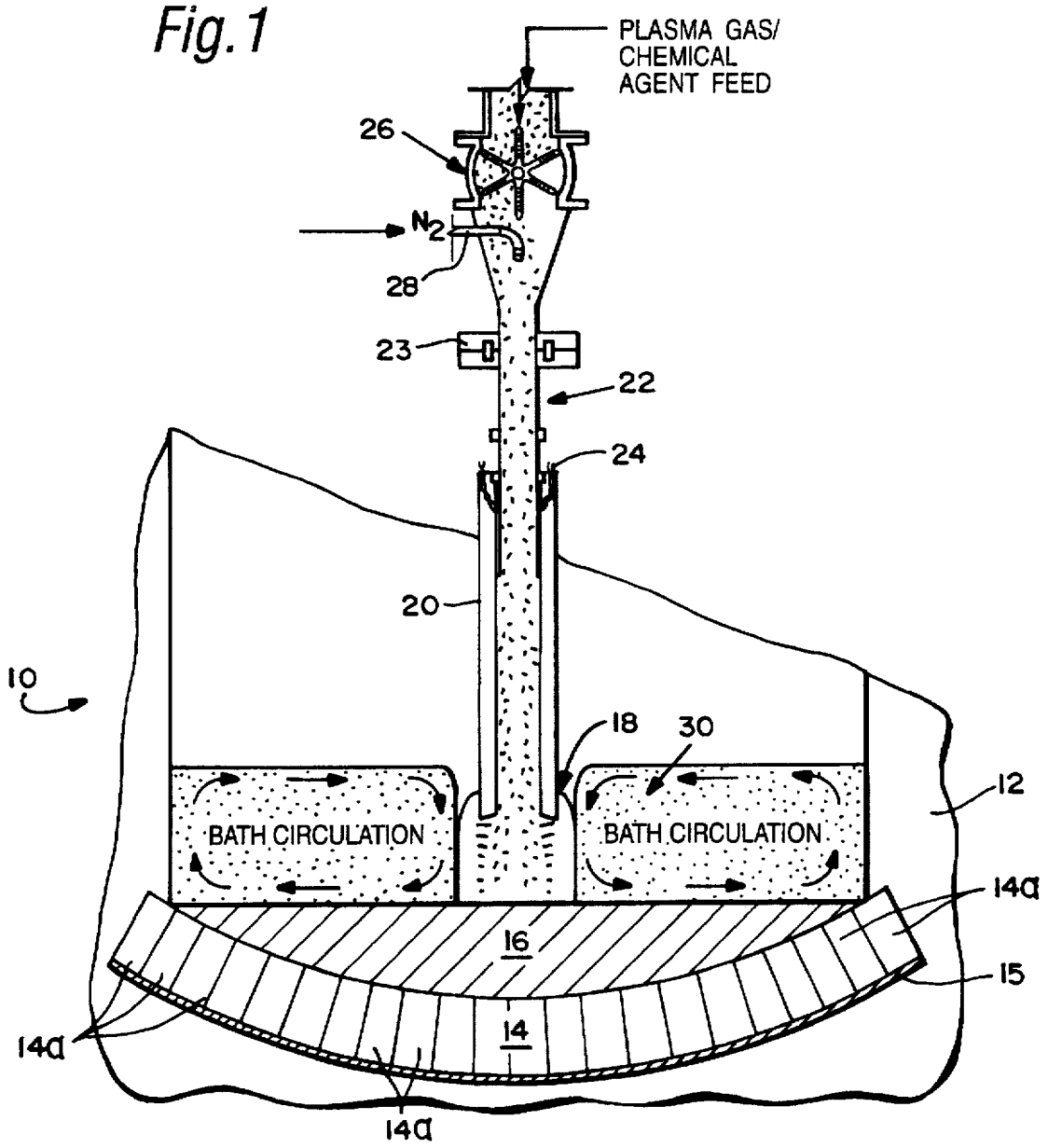

Virtually any chemical munitions may be destroyed by the process of the present invention. In this connection, the process of the present invention is particularly well suited to destroy agents HD (mustard), VX (nerve) and HB having the chemical formulas $C_4H_8C_{12}S$, $C_{11}H_{26}NO_2PS$ and $C_4H_{10}FO_2P$, respectively. Gaseous 2,2'-dichlorodiethyl sulfide (i.e., mustard gas having the formula $(CH_2Cl.CH_2)_2S$) may also be rendered harmless by the process of the present invention. However, while the discussion below will focus upon the destruction of military chemical munitions, the process of the present invention is likewise suitable for rendering harmless virtually any organic industrial waste since the temperatures involved in the process of the present invention are sufficiently high to render organic molecules thermally unstable.

As noted briefly above, the process in accordance with the present invention necessarily employs a DC plasma arc furnace. DC plasma arc furnaces are, in and of themselves well known as evidenced from U.S. Pat. Nos. 3,940,551 and 3,999,000 (the entire contents of each being expressly incorporated hereinto by reference). A particularly preferred plasma arc furnace that may be used in the practice of the present invention is depicted in accompanying FIG. 1 (see also, U.S. Pat. No. 4,177,061, the entire content of which is expressly incorporated hereinto by reference).

As is seen, the plasma arc furnace 10 includes a sealed refractory shell 12, it being understood that the complete shell is not depicted in FIG. 1 for clarity of presentation. A conductive plate 14 with conductive refractories (some of which are identified by reference numeral 14*a*) is embedded in the bottom of the shell 12 and supports a molten iron heel 16 which establishes a plasma arc zone 18 with the terminal end of the hollow graphite electrode 20. A conductive copper plate 15 supports the refractories 14*a*. A stationary feed conduit 22 coaxially enters through the roof of the refractory shell 12 and is sealed by means of high temperature split clamp assembly 23. The feed conduit 22 is coaxially, but slidably, coupled to the upper end of the electrode 20 by suitable adaptor/gas seal structures 24 so as to allow the electrode 20 to be reciprocally moveable relative to the feed conduit 22 towards and away from the iron heel 16. A rotary valve 26 permits the chemical agents (in gaseous, liquid or particulate form) to be introduced into the interior of the furnace 10 concurrently with the plasma gas. An inert gas port 28 downstream of the valve 26 permits an inert gas (e.g., recycled off-gas, $N_2$ or the like) to be introduced into the furnace 10 so as to allow for control over the furnace atmosphere (e.g., so as to create a reducing atmosphere within the furnace 10) thereby reducing final off-gas volume for discharge to atmosphere.

Controlled amounts of an oxidizing gas, such as oxygen, air, or steam, may be introduced into the gas space above the slag 30 within the furnace either through the hollow electrode, or through an auxiliary port in the roof of the furnace (not shown). The preferred embodiment utilizes a metered quantity of oxygen for this purpose so as to minimize the volume of off-gas produced.

The plasma gas which is introduced cocurrently with the chemical munitions through the hollow electrode 20 may be any inert gas, such as $N_2$, Ar or recycled off-gas for additional re-exposure to the plasma arc.

The plasma arc zone 18 is at a temperature above about 30,000° F. At such an ultrahigh temperature, the chemical agents introduced into the furnace 10 will thermodynamically be decomposed to constituent monatomic and/or diatomic ions which combine upon cooling to form, for example, hydrogen, oxygen, nitrogen, carbon monoxide, carbon dioxide, hydrogen chloride, hydrogen fluoride and phosphorus pentoxide as by-products. These by-products may then be removed from the furnace through a discharge port (not shown) located in the upper region of the furnace 10 and recovered using conventional techniques.

Any non-volatilized material introduced in the feed stream will form a slag 30 in an annular zone around the plasma arc zone which circulates in a direction toward the interior of the furnace—i.e., toward the plasma arc zone. The molten slag will be at a temperature at or above 3,000° F. The slag may periodically be withdrawn from the furnace 10 by means of a bottom tap (not shown) so as to maintain the molten slag in the furnace at acceptable levels. Alternatively, for batch-wise processing, the electrode 20 may be raised upwardly from the iron heel as the slag level increases until such time that the distance between the terminal end of the electrode 20 and the iron heel precludes a plasma arc form being formed.

If particulates are fed into the furnace 10, then the size should preferably be not greater than about ⅝-inch nominal diameter.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for destroying chemical agents comprising forming a plasma arc in a DC plasma arc furnace between a terminal end of a hollow electrode and an electrically conductive heel, and introducing a chemical agent into the hollow of the electrode so that the chemical agent is brought into contact with, and destroyed by, the plasma arc at the electrode's terminal end thereof.

2. A process as in claim 1, wherein said chemical agent is a chemical munition.

3. A process as in claim 1, wherein said plasma arc is at a temperature of greater than about 30,000° F.

4. A process as in claim 1, which includes forming a molten slag in an annular zone surrounding said plasma arc.

5. A process as in claim 2, wherein the chemical munition is one selected from the group consisting of agents VX, HB and HD.

6. A process as in claim 1 or 5, wherein the chemical agent is decomposed in to monatomic or diatomic molecules.

7. A process as in claim 6, wherein the chemical agent is decomposed into a gaseous mixture containing at least two or more of hydrogen, oxygen, nitrogen, carbon monoxide, carbon dioxide, hydrogen chloride, hydrogen fluoride and phosphorus pentoxide.

8. A process for the destruction of chemical munitions comprising bringing said chemical munitions into contact with a plasma arc of a DC plasma arc furnace operated at a temperature greater than about 30,000° F.

9. A process as in claim 8, wherein the chemical munition is one selected from the group consisting of agents VX, HB and HD.

10. A process as in claim 9, wherein the chemical agent is decomposed in to monatomic or diatomic molecules.

11. A process as in claim 10, wherein the chemical agent is decomposed into a gaseous mixture containing at least two or more of hydrogen, oxygen, nitrogen, carbon monoxide, carbon dioxide, hydrogen chloride, hydrogen fluoride and phosphorus pentoxide.

* * * * *